US007695374B2

(12) United States Patent
Bellows et al.

(10) Patent No.: US 7,695,374 B2
(45) Date of Patent: Apr. 13, 2010

(54) BOUNCER SEAT ASSEMBLY

(75) Inventors: William B. Bellows, Wyomissing, PA (US); Nicholas E. Papageorge, Upper Darby, PA (US); Baku Kakuda, Reading, PA (US); Thomas M. Perrin, Thorndale, PA (US)

(73) Assignee: Graco Children's Products Inc., Atlanta, GA (US)

( * ) Notice: Subject to any disclaimer, the term of this patent is extended or adjusted under 35 U.S.C. 154(b) by 1012 days.

(21) Appl. No.: 11/385,028

(22) Filed: Mar. 20, 2006

(65) Prior Publication Data

US 2006/0252565 A1 Nov. 9, 2006

Related U.S. Application Data

(63) Continuation-in-part of application No. 11/079,513, filed on Mar. 15, 2005, now Pat. No. 7,326,120.

(51) Int. Cl.
*A63G 9/16* (2006.01)
*A47D 1/02* (2006.01)

(52) U.S. Cl. ..... 472/119; 297/16.1

(58) Field of Classification Search ..... 472/118–125; 297/16.1, DIG. 11, 425.13, 452.2, 334, 440.15, 297/258.11

See application file for complete search history.

(56) References Cited

U.S. PATENT DOCUMENTS 4,822,033 A 4/1989 Kohus et al.
5,411,315 A * 5/1995 Greenwood ..... 297/440.24
5,509,721 A * 4/1996 Huang ..... 297/452.13
5,803,817 A 9/1998 Stern
6,027,409 A 2/2000 Favorito et al.
6,341,816 B1 * 1/2002 Chen et al. ..... 297/16.1
6,361,106 B1 * 3/2002 Huang ..... 297/32
6,386,986 B1 5/2002 Sonner et al.
6,616,237 B2 * 9/2003 Sonner et al. ..... 297/440.22
6,645,080 B1 11/2003 Greger et al.
6,877,802 B2 4/2005 Christensen et al.
7,189,164 B1 3/2007 Paesang et al.
2004/0198512 A1 10/2004 Ransil et al.
2005/0014569 A1 1/2005 Greger et al.

OTHER PUBLICATIONS

Graco 1990 Product Catalog, Convert-Cradle III, 1990, pp. 1,2,6 and 24.
Fisher-Price Smart Stages, 3 in 1 Rocker Swing Instruction Manual, 2004, pp. 1-32, Mattel, Inc.

* cited by examiner

*Primary Examiner*—Kien T Nguyen
(74) *Attorney, Agent, or Firm*—Lempia Braidwood LLC

(57) ABSTRACT

A bouncer seat assembly generally has a wire frame structure and a seat suspended from the wire frame structure. The wire frame structure includes a seat section and a base section resiliently and flexibly coupled to and supporting the seat section above the base section. The wire frame structure is configured so that any gap between parts of the bouncer seat assembly is either sized small enough to prohibit a head of a child from fitting between any adjacent parts or sized large enough to prevent a head of a child from being entrapped or pinched between any adjacent parts.

18 Claims, 15 Drawing Sheets

BOUNCER SEAT ASSEMBLY

RELATED APPLICATION DATA

This patent claims priority benefit and is a continuation-in-part of U.S. patent application Ser. No. 11/079,513, which was filed on Mar. 15, 2005.

BACKGROUND

1. Field of the Disclosure

The invention relates to bouncer seats, and more particularly to bouncer seat with a wire frame configuration that is formed to avoid entrapment or pinch zones, and that optionally can be attached to and detached from a child swing frame.

2. Description of Related Art

Various types of child bouncer seats are known in the art. Child bouncer seats include a support frame and a seat that fits onto the support frame. A child can bounce up and down on the support frame to provide the child with some amusement. Some bouncer seats also can vibrate or play music.

Various types of child swings also are known in the art. These include both open top child swings and closed top child swings. Typically, child swings include a support frame, hanger arms pivotally attached to the support frame, and a seat attached to the hanger arms. Electrically or mechanically powered drive mechanisms are utilized to supply energy to the swing to move the swing seat in a reciprocal motion back and forth.

Children need constant supervision and may fall asleep when placed in a swing. Most commercially available child swings are cumbersome and too large to be easily moved from room to room. To avoid leaving a child unattended in the swing, a caregiver must either remain in one location with the swing or must remove the child from the swing and carry the child as the caregiver moves from one location to another. If the child has fallen asleep in the swing, removing the child may wake up the child and cause the child to cry.

Child swings have been developed that include detachable swing seats so that a parent can transport a sleeping child in the swing seat to a different location without disturbing the child. Once the swing seat is set on the ground or other stationary surface, however, the child generally wakes up due to the abrupt disruption of movement.

Bouncer seats typically have a wire frame construction. There are areas within the frame where a child can become pinch or entrapped, which can cause harm or even death to the child. These problems may be magnified if the bouncer seat is one that can be lifted up off the ground and suspended in a child swing frame. With the bouncer seat suspended above the floor, another child roaming beneath the seat may be at greater risk of becoming caught in a portion of the bouncer seat frame, particularly if the seat is moving in a swinging.

SUMMARY OF THE INVENTION

An aspect of the present invention relates to a child swing. The child swing includes a swing frame, at least one hanger arm rotatably coupled to the swing frame, and a bouncer seat assembly including a bouncer frame and a seat coupled to the bouncer frame. The bouncer seat assembly is adapted to be attached to and detached from the at least one hanger arm. When the bouncer seat assembly is coupled to the at least one hanger arm, the bouncer frame and the seat can undergo swinging movement with the at least one hanger arm relative to the swing frame. When the bouncer seat assembly is detached from the at least one hanger arm and placed on a surface, the bouncer frame allows the seat to undergo bouncing movement relative to the surface.

Another aspect of the present invention relates to a child swing. The child swing includes a swing frame and at least one hanger arm moveably coupled to the swing frame. The at least one hanger arm has a mount with an arcuate surface. The child swing further includes a seat and at least one attachment assembly associated with the seat. The attachment assembly has a complementary arcuate surface and is adapted to be coupled to the mount of the at least one hanger arm. The arcuate surface and the complementary arcuate surface are adapted to move relative to each other to allow the seat to recline relative to the at least one hanger arm.

Yet another aspect of the present invention relates to a child swing. The child swing includes a swing frame and first and second hanger arms moveably coupled to the swing frame, each of the first and second hanger arms including a mount. The child swing also includes a seat adapted to be attached to or detached from the respective mounts of the first and second hanger arms. The first and second hanger arms are separate from one another on the child swing.

A further aspect of the present invention relates to the bouncer seat frame. The frame is configured so that is avoids or inhibits entrapment or pinch regions where a child could get injured. The disclosed bouncer seat frame can be incorporated into a bouncer that is not constructed to be used with a swing frame. However, the bouncer seat example disclosed herein is configured to be removably suspended on hanger arms of a child swing.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION

Figure 1:
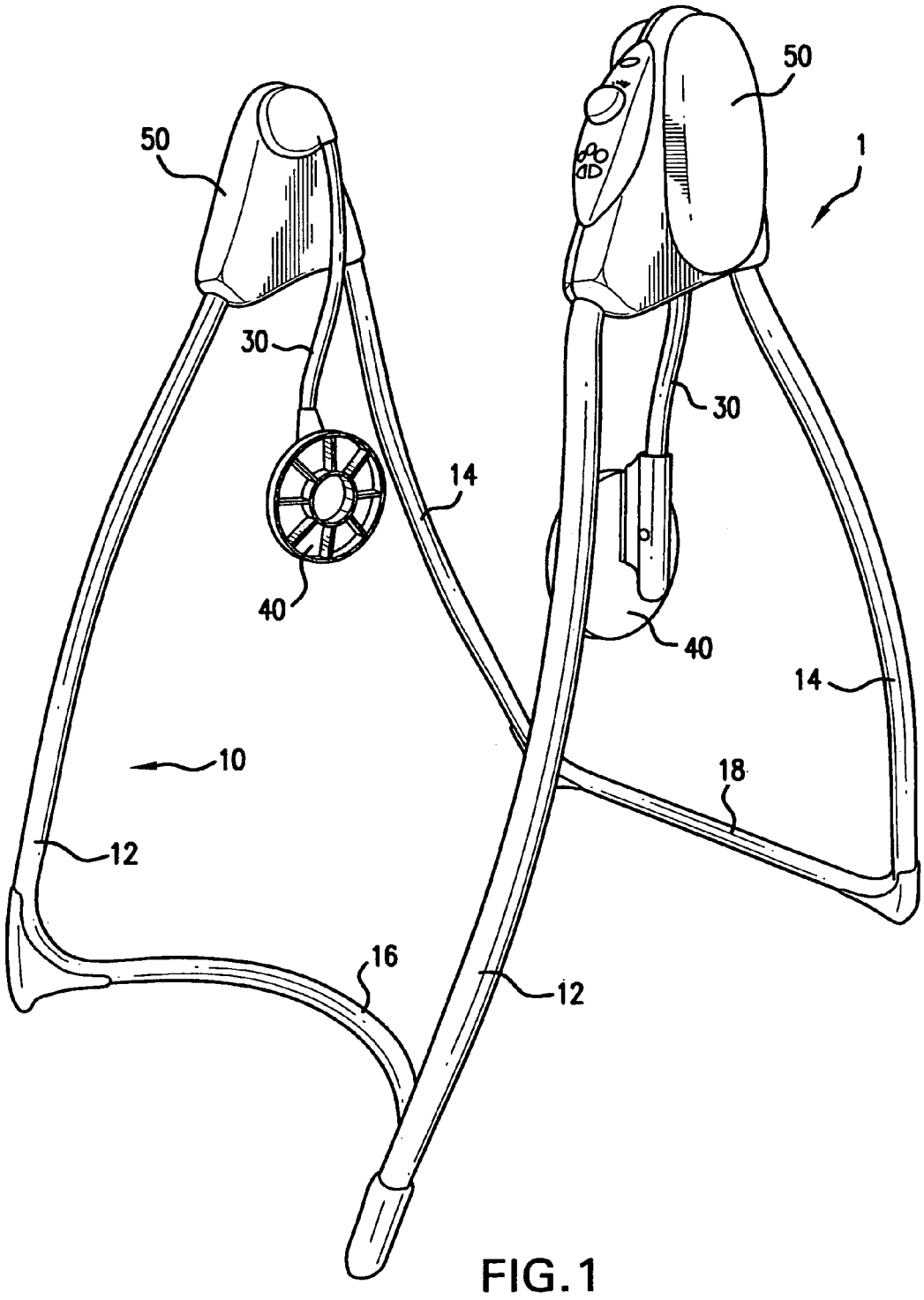
FIG. 1 is a perspective view of an embodiment of a swing frame and hanger arms according to the invention.

Reference will now be made in detail to embodiments of the invention, examples of which are illustrated in the accompanying drawings. An effort has been made to use the same reference numbers throughout the drawings to refer to the same or like parts.

FIGS. 1-4 illustrate different views of a swing 1 according to an embodiment of the present invention. The swing 1 includes a swing frame 10. The swing 1 also includes at least one hanger arm 30 rotatably coupled to the swing frame 10. The swing frame 10 supports the hanger arms 30 so that a bouncer seat assembly 22 can be suspended from the swing frame 10. The bouncer seat assembly 22 includes a seat 20 and a bouncer frame 77. The bouncer seat assembly 22 is adapted to be attached to and detached from the hanger arms 30. When the bouncer seat assembly 22 is attached to the hanger arms 30, the bouncer seat assembly 22 can undergo swinging movement with the hanger arms 30 relative to the swing frame 10. When the bouncer seat assembly 22 is detached from the hanger arms 30 and placed on a surface, the bouncer frame 77 allows the seat 20 to undergo bouncing movement relative to the surface. When a caregiver has to leave an area where the swing 1 is located, the caregiver can remove the bouncer seat assembly 22 from the swing 1, carry the bouncer seat assembly 22 with child to a new location, and place the bouncer seat assembly 22 on a support surface, such as a floor. The child, who previously had been entertained and soothed by the swinging motion of the swing 1, now can be entertained and soothed by the bouncing motion of the bouncer seat assembly 22.

In electric swings, the swing 1 can include a motor mechanism and a power supply for supplying power to the motor mechanism to drive swinging motion of the seat 20. The motor mechanism and the power supply can be disposed within a frame housing 50. The power supply may be, for example, a battery pack.

The swing frame 10 generally includes first and second front legs 12, first and second rear legs 14, frame housings 50 to which the front and rear legs 12, 14 are coupled, a front cross member 16 extending between the front legs 12, and a rear cross member 18 extending between the rear legs 14. In other embodiments, the swing frame 10 can include first and second front legs only or first and second rear legs only. Other swing frame embodiments, such as those with different-shaped legs, various fold configurations, and different sizes (full, compact, travel) are contemplated by the invention.

As shown in FIG. 1, the area between uppermost portions of the swing frame 10 is open so that a child can easily be installed in or removed from the seat 20 by a caregiver. The bouncer seat assembly 22 of the child swing 1 can be removed from the hanger arms 30, without the use of tools or disassembly of the swing frame 10. When the bouncer seat assembly 22 is removed from the hanger arms 30, an area between the innermost components of the hanger arms 30 is open and unobstructed. For example, the area between the mounts 40 is open and unobstructed. The open top style of the swing 1 enables the user to install the child in the seat 20, or remove the child from the seat 20, when the seat 20 is suspended from the swing frame 10. The seat 20 can be removed from a closed top swing with slightly more difficulty, but still in a relatively straightforward manner.

The swing frame 10 optionally can be configured to fold. For example, the front legs 12 and the rear legs 14 can be assembled so as to pivot relative to each other within the respective frame housings 50, such as disclosed in U.S. Pat. No. 6,645,080, issued Nov. 11, 2003, and U.S. Publication No. 2004/0198512 A1, published Oct. 7, 2004, both of which are incorporated by reference herein in their entirety. A caregiver can fold the swing frame 10, for example, by moving the rear legs 14 toward the front legs 12.

The hanger arms 30 are positioned to engage the swing frame 10 via the frame housings 50 as described above, so that the bouncer seat assembly 22 is suspended from the swing frame 10 in a stable manner. In one embodiment, the hanger arms 30 can swing independently relative to the swing frame 10. For example, one hanger arm 30 can be driven by the motor mechanism, while the other hanger arm 30 is not. When a caregiver activates the motor mechanism, motion can be transmitted through one of the frame housings 50 (the one housing the motor mechanism) to one of the hanger arms 30, a 'lead' hanger arm. The non-motor-controlled hanger arm 30, a 'follower' hanger arm, joined to the lead hanger arm by the presence of the bouncer frame assembly 22 on the hanger arms 30, can follow the motion of the lead hanger arm 30. The bouncer seat assembly 22 can thus swing back and forth on the swing frame 10 in a forward direction and a rearward direction.

Figure 4:
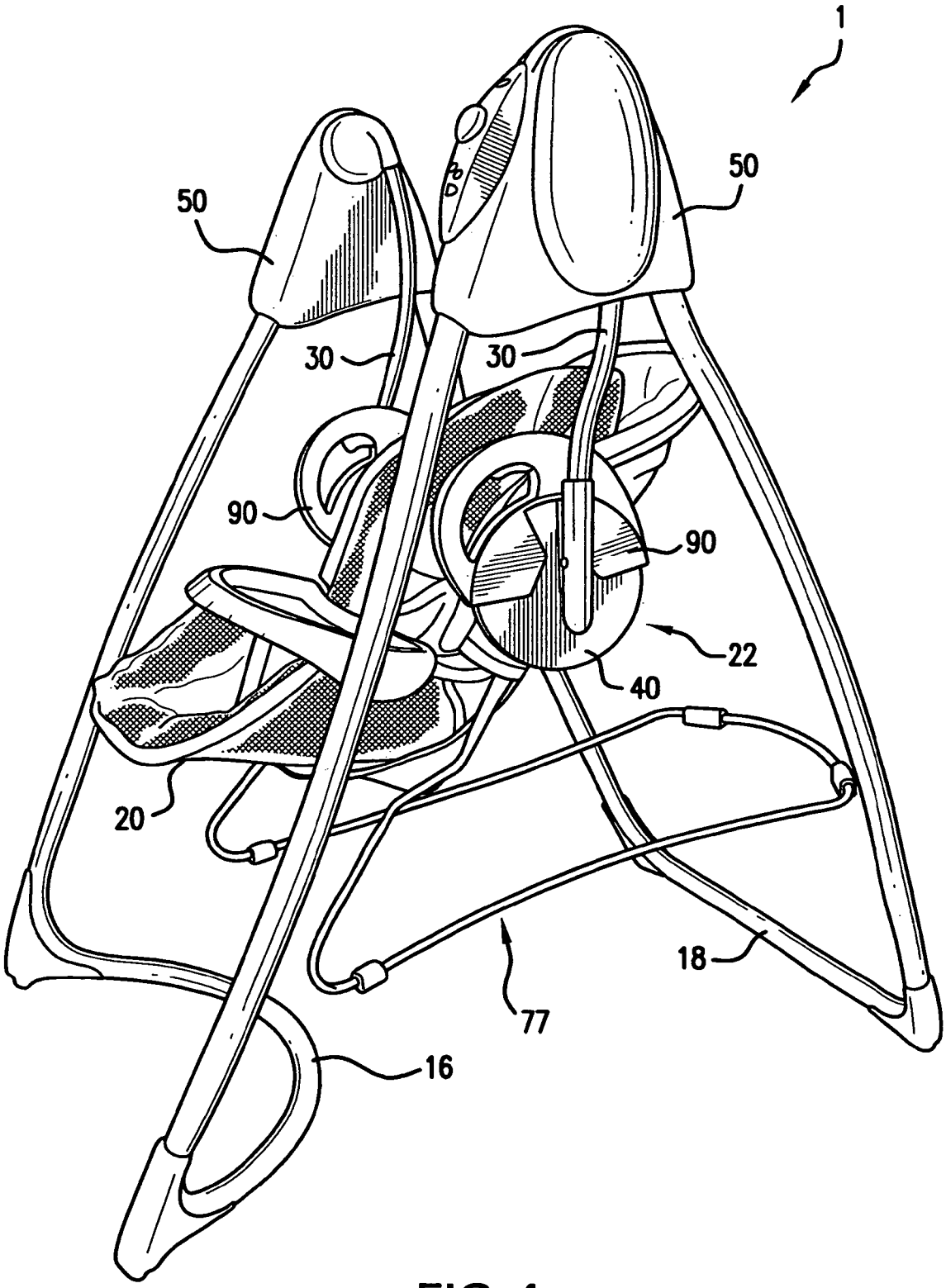
FIG. 4 is a perspective view of an embodiment of a swing according to the invention.
Figure 7:
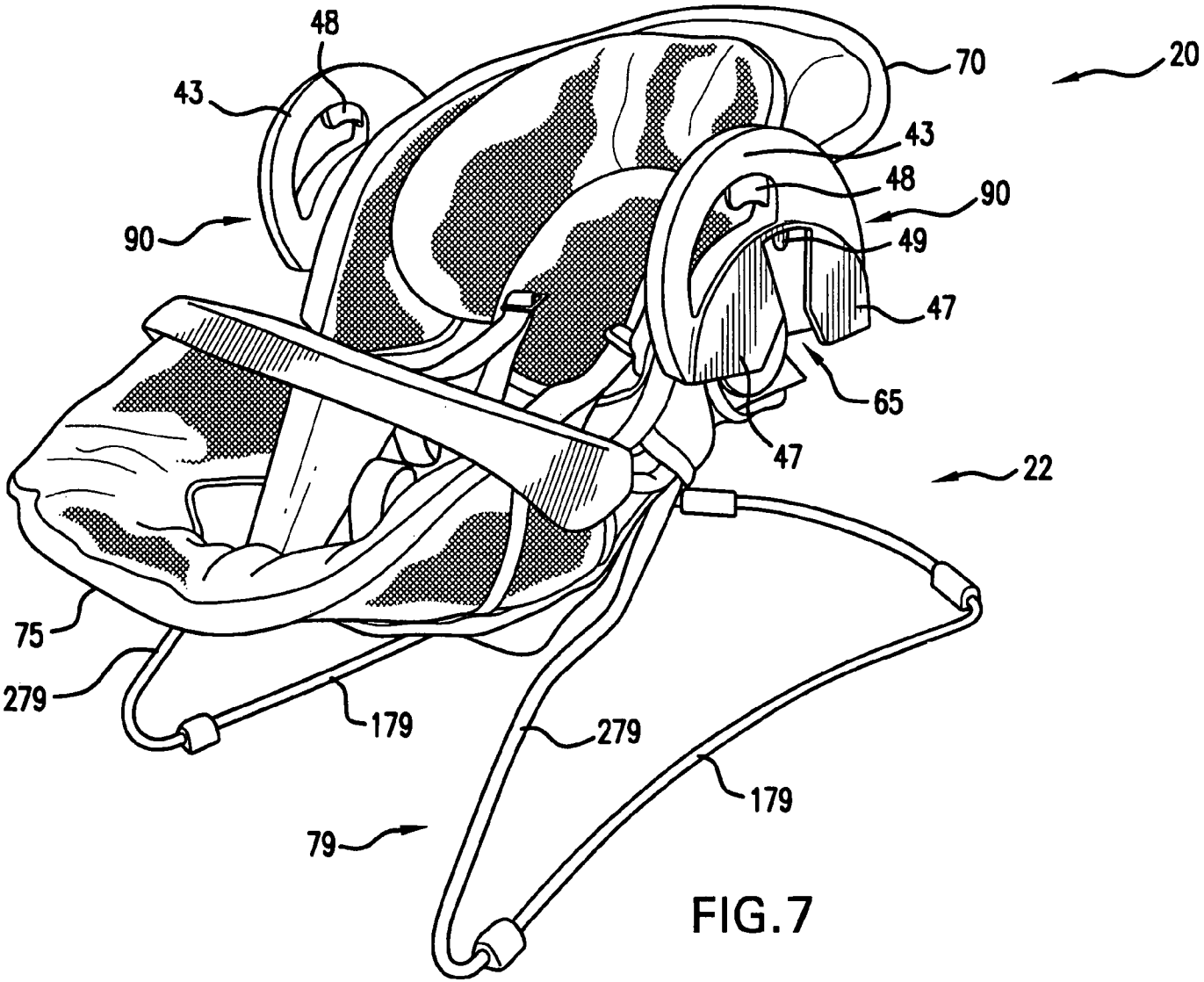
FIG. 7 is a perspective view of a seat and bouncer frame assembly according to the invention.
Figure 8:
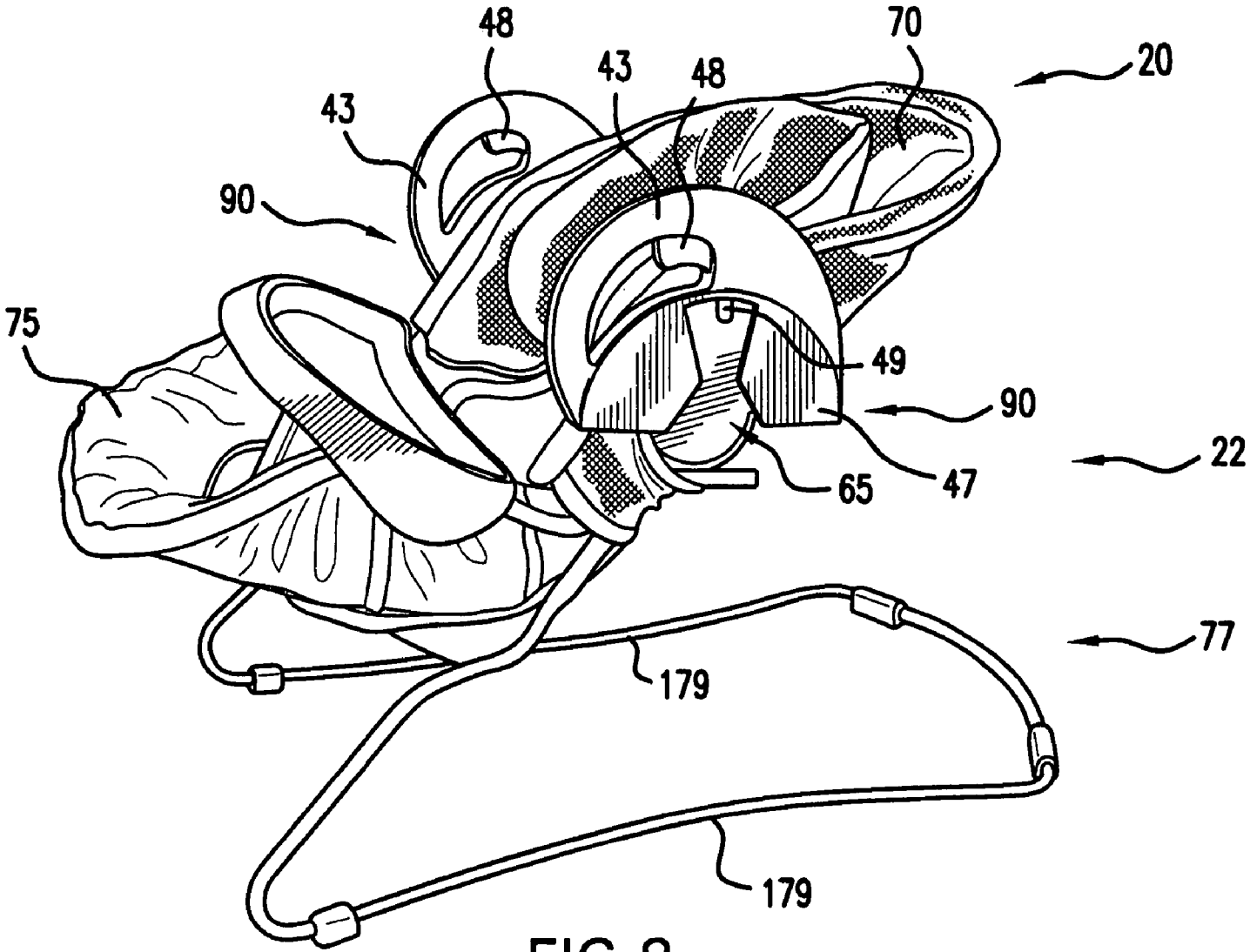
FIG. 8 is a side perspective view of the seat and bouncer frame assembly.
Figure 9:
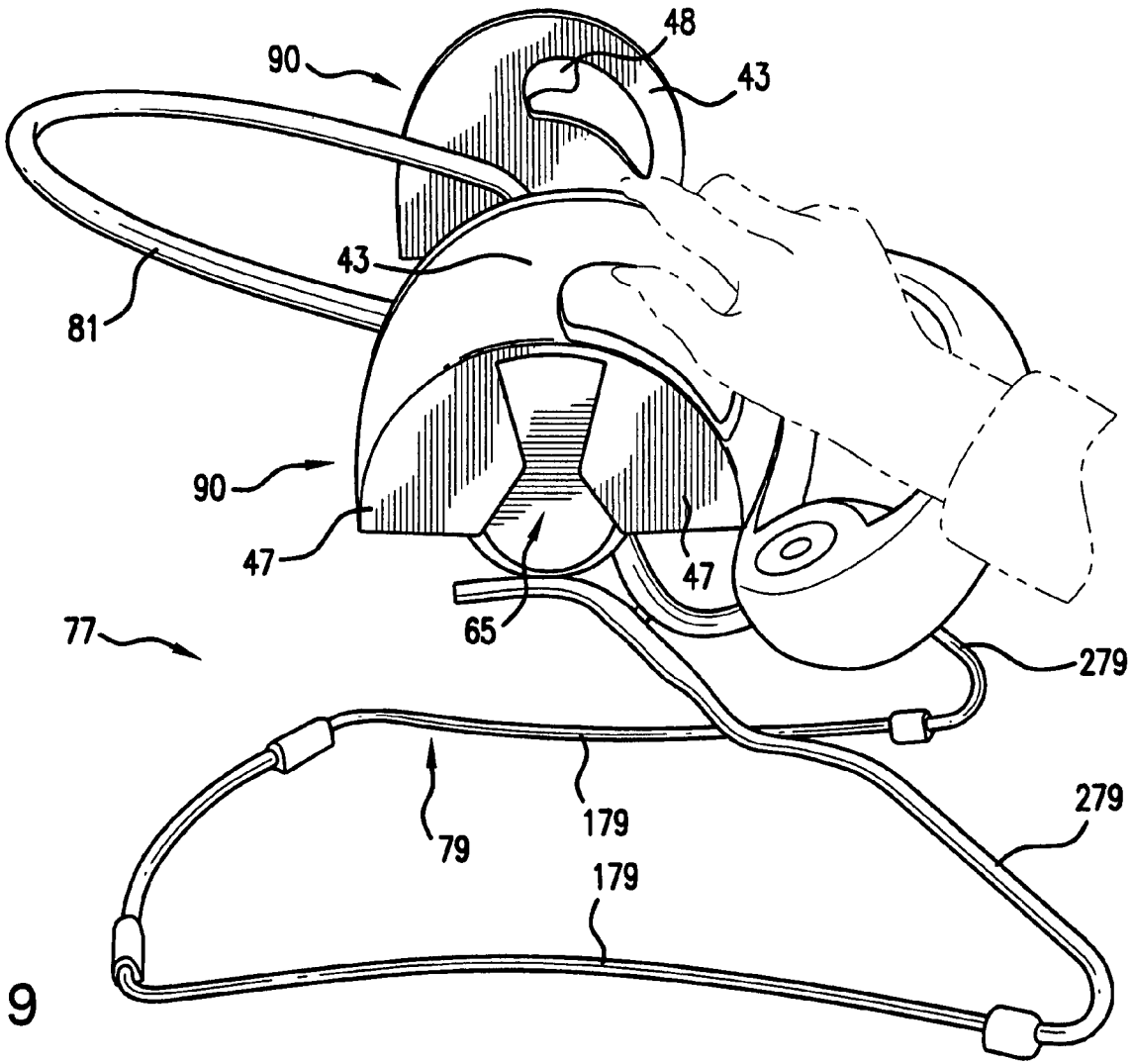
FIG. 9 is a side elevation view of the bouncer frame.

As mentioned above, the bouncer seat assembly 22 is suspended from the swing frame 10 by the hanger arms 30, as seen in FIG. 4. FIGS. 7 and 8 show different views of the bouncer seat assembly 22 that can be coupled to the swing 1 in accordance with one embodiment of the invention. FIG. 9 shows the bouncer seat assembly 22 without the seat 20, in which only the bouncer frame 77 is shown. The bouncer frame 77 can be formed by a wire frame, a plastic tubular frame, non-tubular plastic frame members, or other suitable frame members.

The bouncer frame 77 supports soft goods in the form of the seat 20. As shown in FIGS. 7 and 8, the seat 20 includes a seat back 70 and a seat bottom 75 so that the child can be comfortably positioned in the seat 20. The bouncer frame 77 coupled to the seat 20 is configured to support the seat 20 when the seat 20 is detached from the swing frame 10 and placed on a support surface, such as a floor or a table.

As shown in FIG. 9, the bouncer frame 77 includes a base frame 79 and a seat support frame 81. The base frame 79 can include left and right side base frame members 179, which can rest on the support surface, and left and right side arm members 279, which extend upwardly from the base frame members 179 toward the seat support frame 81. The left and right side base frame members 179 can curve inwards towards each other at an intermediate section along their respective lengths. The base frame 79 thus can be wider in the front and the back than in the middle, to provide a stable frame for the seat 20 that it supports. The curved nature of the base frame 79 allows a caregiver to easily attach the bouncer seat assembly 22 onto the swing 1 and detach it from the swing 1; the curved base frame members 179 provide clearance for the hanger arms 30, frame housings 50, and other portions of the swing frame 10 during the attachment/detachment process.

The bouncer frame 77 also includes attachment assemblies 90, which are coupled to the seat support frame 81. In an alternative configuration, the attachment assemblies 90 can be coupled to the base frame 79. The attachment assemblies 90 can be screwed in place or bolted in place on the bouncer frame 77. The attachment assemblies 90 can releasably attach to the hanger arms 30 of the swing 1, which will be explained in more detail below.

The hanger arms 30 each include a hanger mount 40. The hanger mounts 40 are configured to attach to the attachment assemblies 90 of the bouncer seat assembly 22, so that the seat 20 can be suspended from the swing frame 10.

Figure 2:
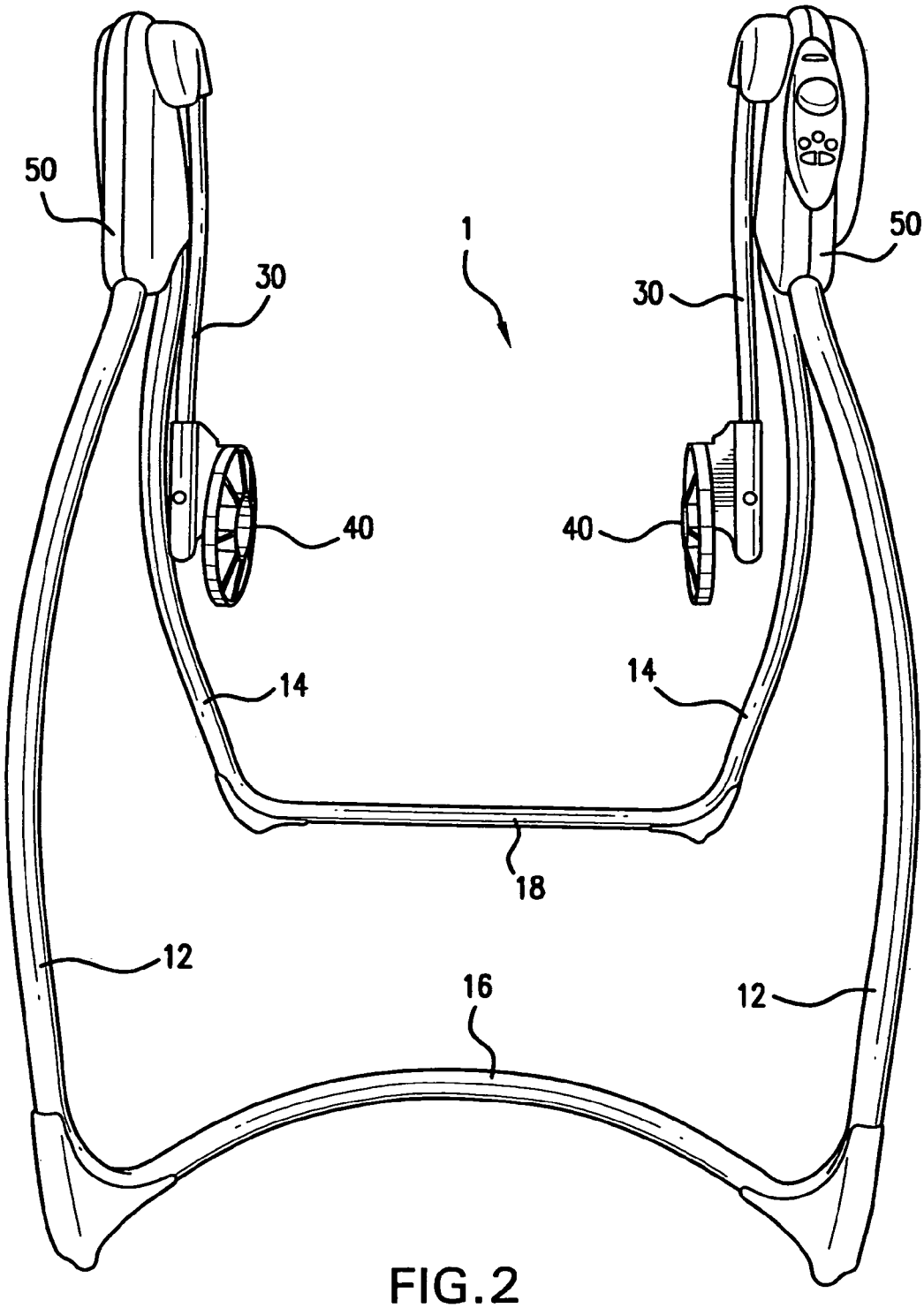
FIG. 2 is a front view of the swing frame and hanger arms.
Figure 3:
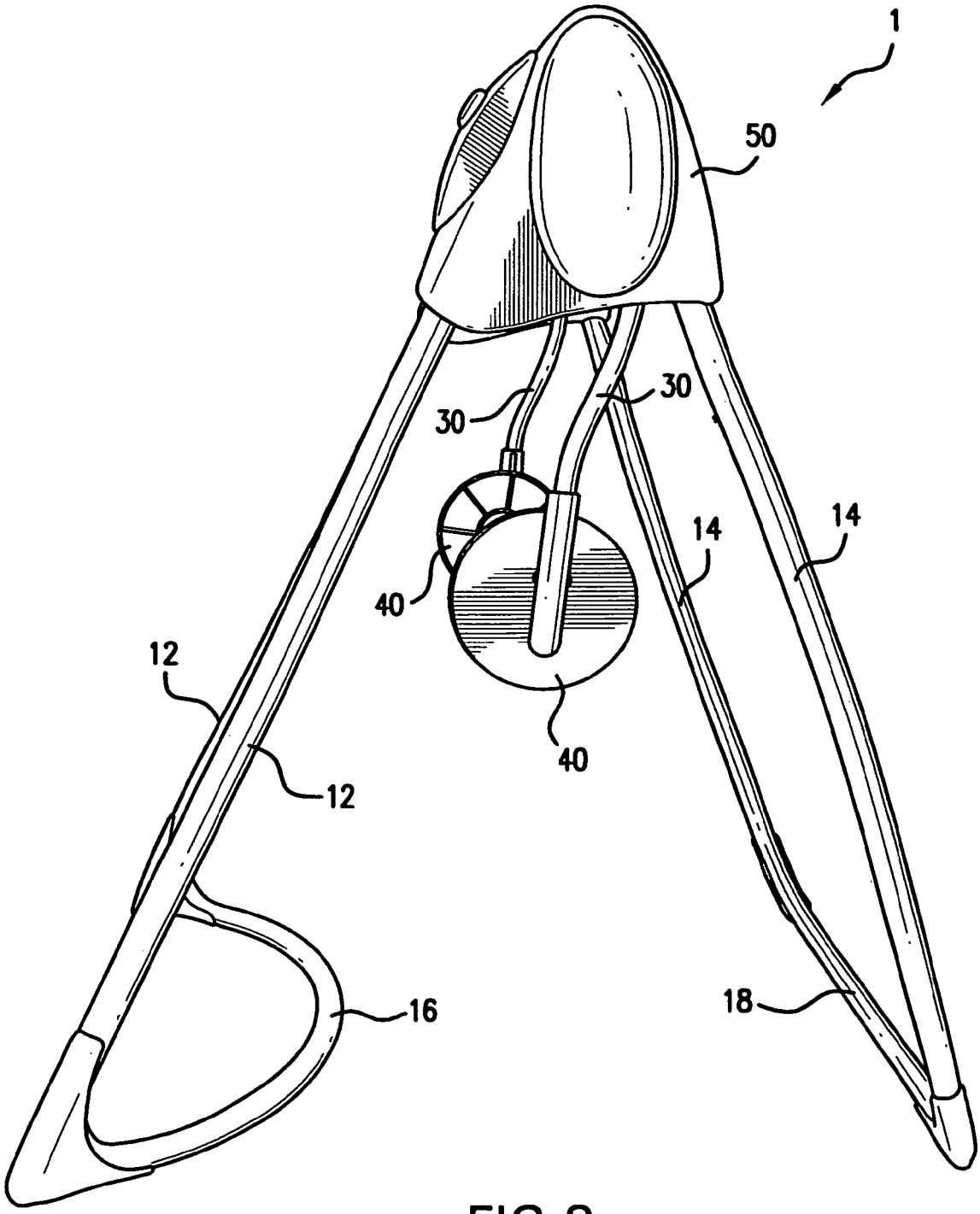
FIG. 3 is a side elevation view of the swing frame and hanger arms.

In a first embodiment, the mounts 40 preferably have an arcuate shape (they can be circular shaped or disk shaped) and are located at an end portion of the hanger arms 30, as shown in FIGS. 1-3. Alternatively, the mounts 40 can be located elsewhere, such as at a half-way position or at a three-quarters position, on the hanger arms 30. Each mount 40 is configured to receive a respective attachment assembly 90 of the bouncer seat assembly 22, to allow the bouncer seat assembly 22 to be readily coupled to and decoupled from the swing 1. The arcuate-shaped mounts 40 provide an easy to align, self-centering landing location for the bouncer seat assembly 22, when the bouncer seat assembly 22 is coupled to the swing 1.

Figure 5:
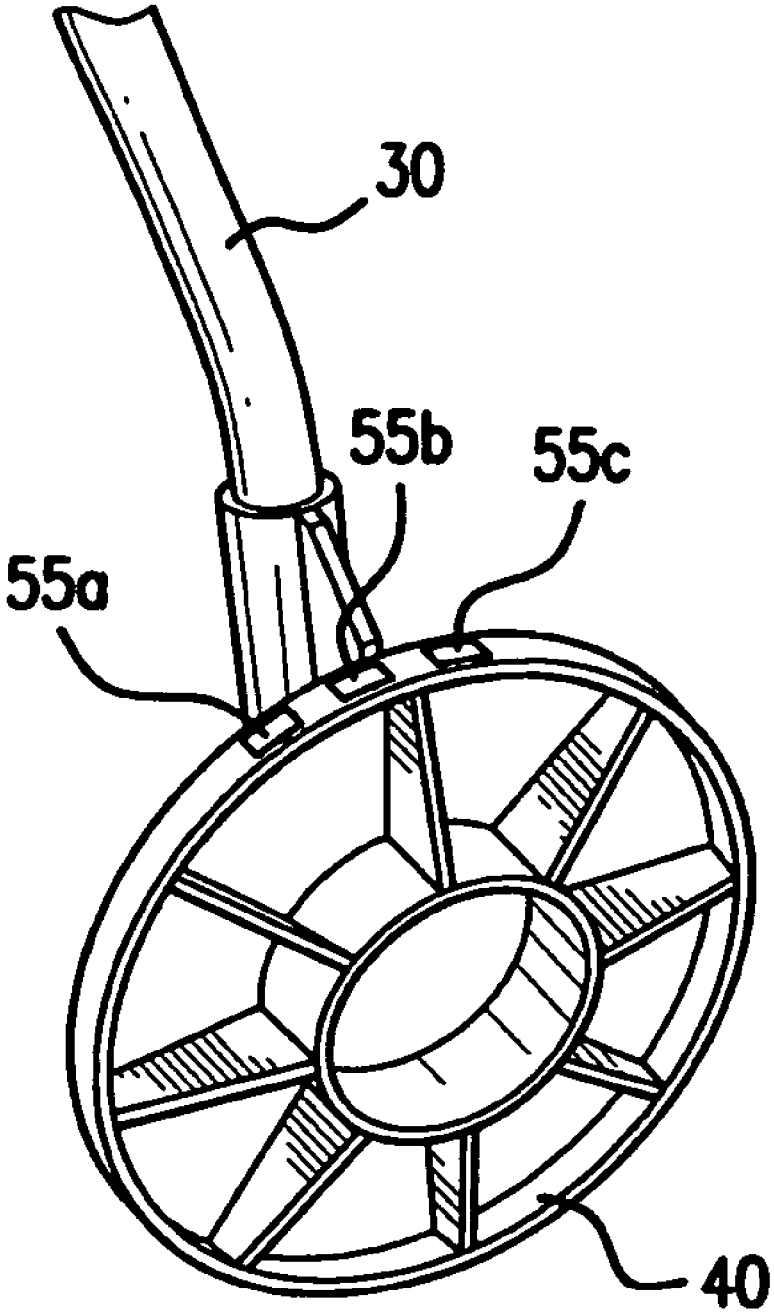
FIG. 5 is a perspective detail view of a hanger arm, including a mount, of the swing.
Figure 6:
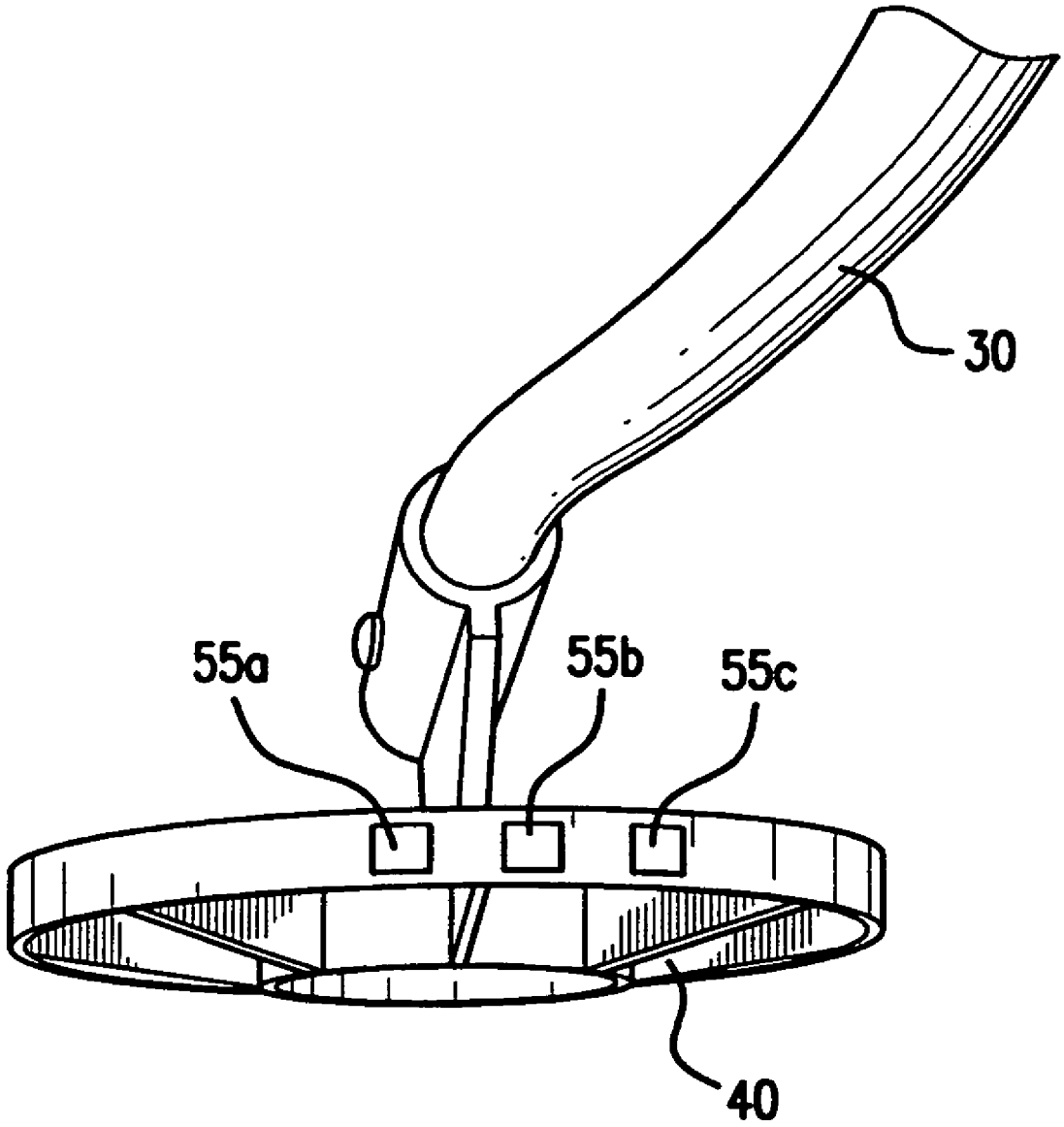
FIG. 6 is a top perspective view of a hanger arm, including the mount, of the swing.

Referring now to FIGS. 5 and 6, at least one of the mounts 40 has at least one slot provided thereon. The at least one slot can be provided on a top surface of the mount 40. Preferably, there are three slots provided on the mount 40. A first slot 55*a* corresponds to an recline position of the bouncer seat assembly 22 when attached to the swing 1, a second slot 55*b* corresponds to an intermediate position of the bouncer seat assembly 22 when attached to the swing 1, and a third slot 55*c* corresponds to an incline position of the bouncer seat assembly 22 when attached to the swing 1. Each slot 55*a*, 55*b*, 55*c* is sized to accommodate a coupling mechanism of an attachment assembly 90, such as a tab, as will be described in more detail below.

FIGS. 7-9 show first and second attachment assemblies 90 fixedly attached to first and second sides of the seat support frame 81. Each attachment assembly 90 preferably includes a hand grip housing 43, a mount attachment housing 47, a latch 48, and a tab (or coupling mechanism) 49. As shown in FIGS. 7 and 8, the tab 49 is normally in an extended position. A spring assembly (contained within hand grip housing 43) is coupled to the latch 48 and maintains the tab 49 in its extended position when the latch 48 is not actuated by a caregiver. When the latch 48 is actuated by the caregiver, as shown in FIG. 9, the tab 49 can move inwards towards a top (curved) surface of the mount attachment housing 47, and the tab 49 is hidden from view. When the bouncer seat assembly 22 is to be attached to the swing 1, the caregiver can place the first and second attachments arms 90 over the respective mounts 40 of the hanger arms 30 and can position the mount attachment housings 47 on the mounts 40 so that the tabs 49 can engage a desired slot 55*a*, 55*b*, 55*c* on the mounts 40.

The caregiver can select an appropriate recline position for the bouncer seat assembly 22 (and therefore the seat 20) on the swing 1 by positioning the tabs 40 in one of the three slots 55*a*, 55*b*, 55*c* corresponding to that recline position on each mount 40. When the tab 49 is fitted within one of the slots of the mount 40, the bouncer seat assembly 22 is held in place at a predetermined recline angle on the swing 1.

Figure 11B:
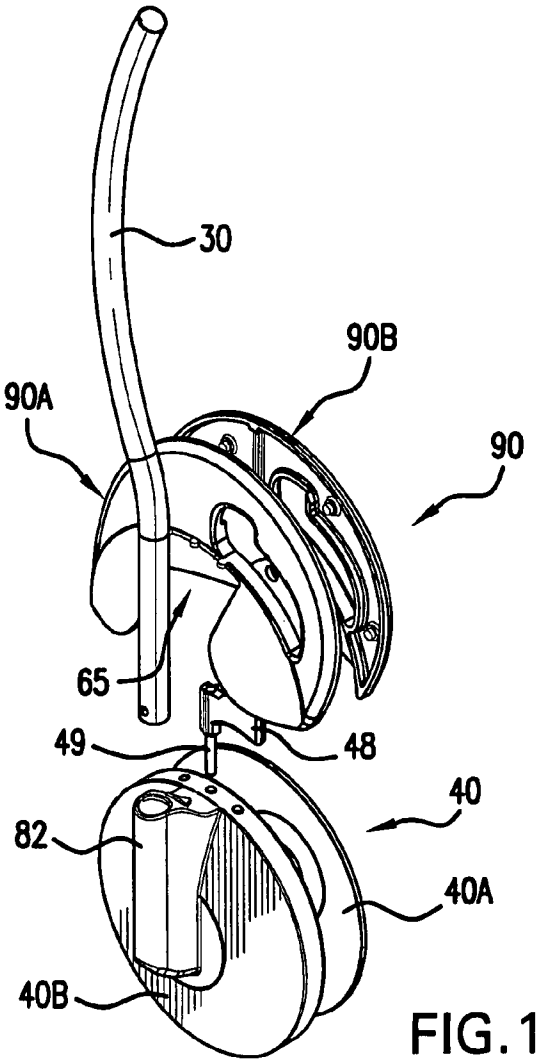
FIGS. 11A and 11B are exploded front and perspective views of the hanger arm/mount assembly and the attachment assembly.
Figure 11A:
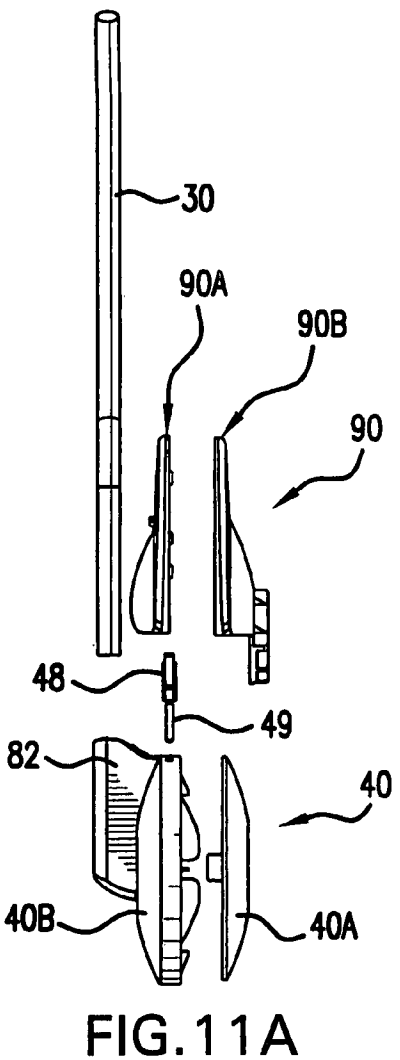
Figure 12:
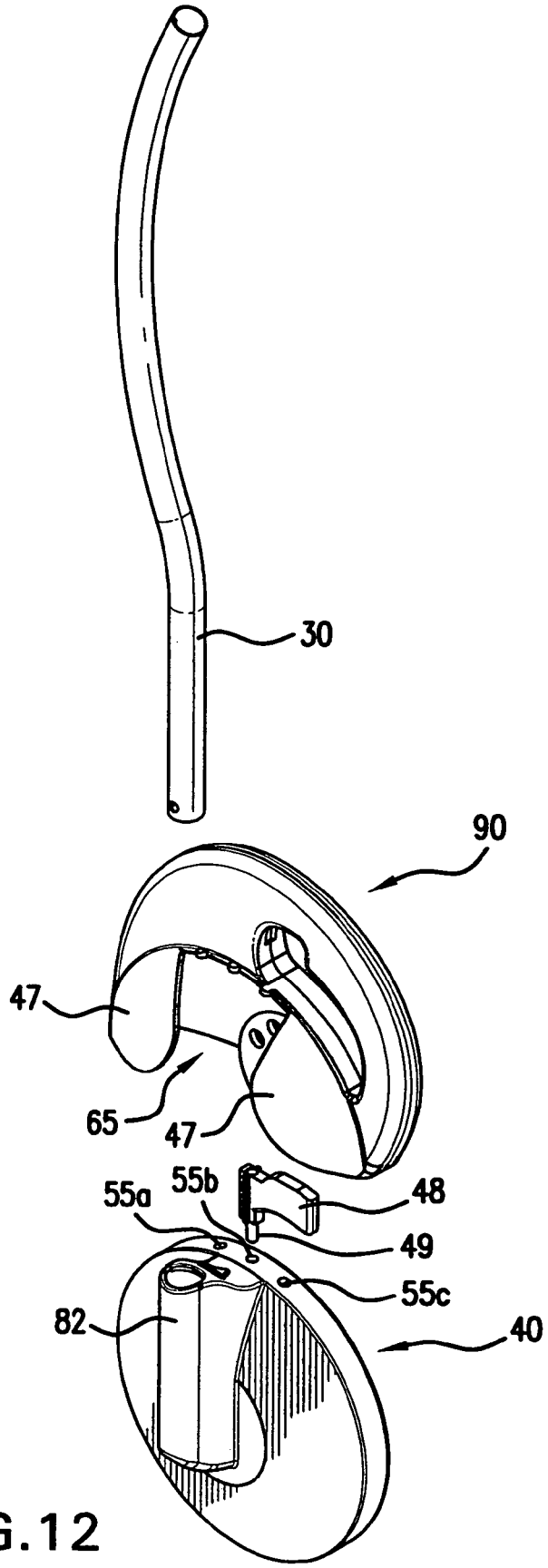
FIG. 12 is an exploded perspective view of the hanger arm/mount assembly and the attachment assembly.

The mounts 40 of the swing 1 support the weight of the bouncer seat assembly 22 by their being in direct contact with, and being disposed beneath, the attachment assemblies 90 of the bouncer frame 77. In more detail, each of the first and second attachment assemblies 90 includes a half-circular shaped attachment housing 47, which has the same shape (or substantially the same shape) as the top half of the mount 40 to which it is to be coupled. The mounts 40 and the attachment housings 47 have arcuate surfaces that are complementary with each other. For example, each can have a convex shape, as seen in FIGS. 10-12; in alternative embodiments, each can have a concave shape, or each can have an oval shape. The arcuate surface of the mounts 40 and the complementary arcuate surface of the attachment housings 47 are adapted to move relative to each other to allow the seat 20 to smoothly change between recline angles relative to the hanger arms 30. In an alternative embodiment, the mounts 40 and the attachment housings 47 each can have a shape that is non-arcuate (e.g., trapezoidal, triangular, etc.), with the shape being the same for both of them. The mounts 40 and the attachment housings 47 can readily be coupled to each other and decoupled from each other due to their same or substantially same mating surfaces, and the bouncer seat assembly 22 can be moved to a desired recline position by a caregiver in a relatively easy manner.

Figures 10A, 10B, 10C:
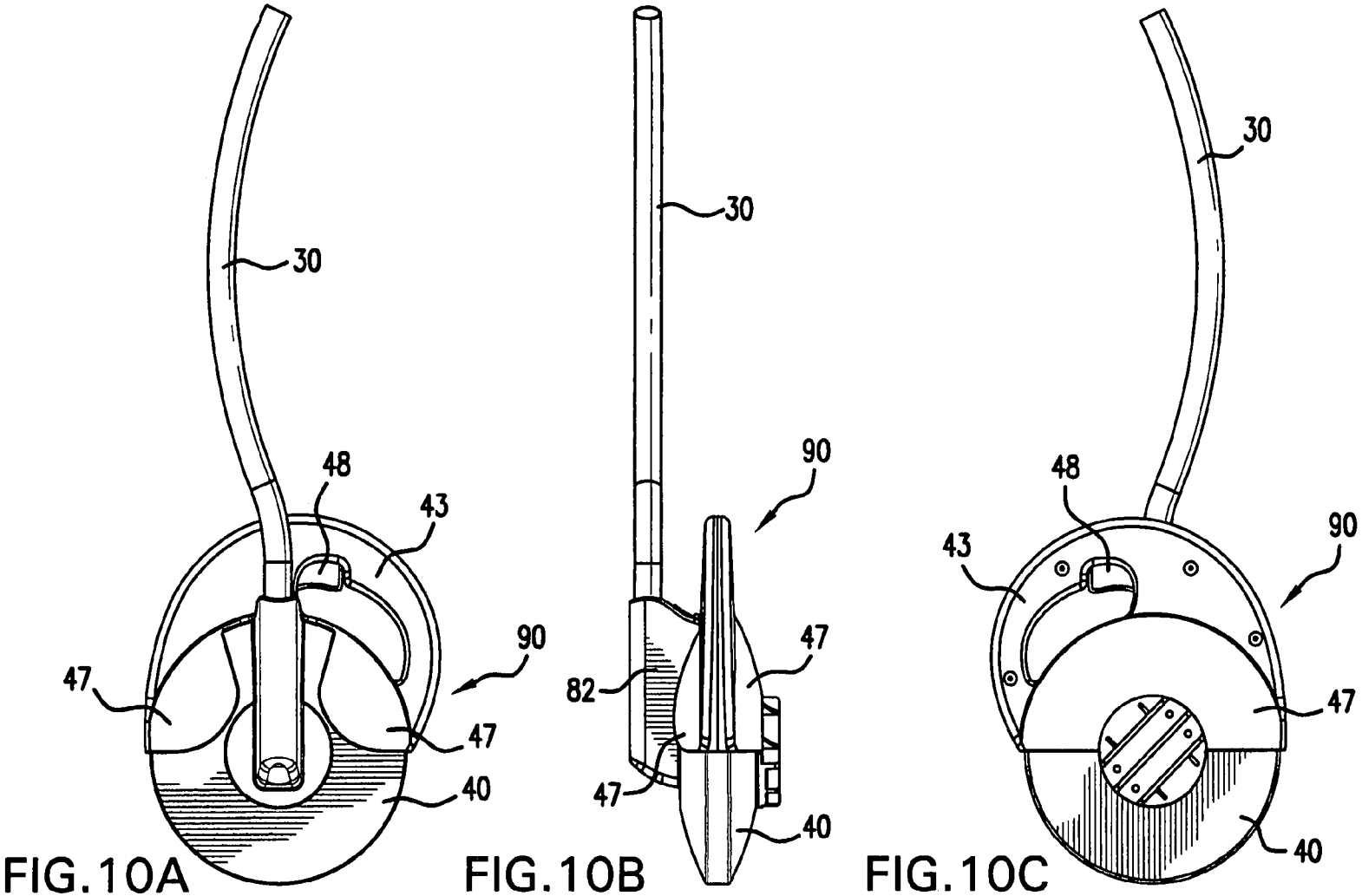
FIGS. 10A, 10B and 10C are detail outer side, front and inner side views of the hanger arm/mount assembly and an attachment assembly.

When a caregiver desires to attach the bouncer seat assembly 22 to the swing 1, the caregiver slides the first and second side attachment housings 47 over the respective mounts 40, allowing a post receiving portion 82 of the mounts 40, as shown in FIG. 10B, to pass through channels 65 provided on an outer sidewall of the attachment assemblies, as shown in FIG. 9. In particular, the caregiver positions the channels 65 of the left and right attachment housings 47 over the first and second mounts 40, respectively, and then lowers the bouncer seat assembly 22 until the attachment housings 47 engage the top portion of the mounts 40. The caregiver need not actuate the latch 48 at this time; the tabs 49 of the first and second attachment assemblies 90 go simply into a desired one of the slots 55*a*, 55*b*, 55*c* on the respective mounts 40.

When the caregiver desires to remove the bouncer seat assembly 22 from the swing 1, and the tabs 49 of the attachment assemblies 90 are positioned in either of slots 55*a* or slots 55*c* of the mounts 40, the caregiver need only actuate the latches 48, which lifts the tabs 49 from the slots, and, at the same time, lift the bouncer seat assembly 22 upwards to detach it from the mounts 40. When the tabs 49 are positioned within slots 55*b*, the caregiver does not need to actuate the latches 48 to lift the bouncer seat assembly 22 away from the mounts 40. The caregiver can then take the bouncer seat assembly 22, with child, to a new location, and place the bouncer seat assembly 22 on a support surface, such as a floor.

The coupling of a tab 49 into a slot of the mount 40 can provide a secondary locking mechanism for securing the bouncer seat assembly 22 to the swing 1. When the tab 49 is fitted into the middle slot 55*b* of the mount 40, which is provided at a 0 degree (top) position on the circular-shaped mount 40, the tab 49 fits directly into the slot 55*b*; no secondary locking feature exists for this coupling. However, when the tab 49 is fitted into either the recline slot 55*a* or the incline slot 55*c*, the tab 49 enters the slot 55*a* or 55*c* at a non-90 degree angle, and the tab 49 is held in place against a sidewall of the slot 55*a* or 55*c*. This non-orthogonal (angle different than 90 degrees) coupling of the tab 49 to the slot 55*a* or 55*c* provides for a secondary locking mechanism for the bouncer seat assembly 22. In order to unlock the tabs 49 of attachment assemblies 90 from slots 55*a* or slots 55*c* of the respective mounts 40, so as to change the recline position of the bouncer frame assembly 22 or to remove the bouncer seat assembly 22 from the swing frame 10, the caregiver can actuate the latches 48, and at the same time lift the bouncer seat assembly 22 off of the mounts 40 of the hanger arms 30.

In another embodiment, slots can be provided on a side surface of the mounts 40, instead of at the top surface of the mounts 40, and a tab can extend laterally from a sidewall of the respective attachment housings 47. In this embodiment, the tab-into-slot coupling provides for a secondary locking mechanism for holding the bouncer seat assembly 22 onto the swing 1. Because the tab-into-slot coupling extends transversely to the direction in which the bouncer seat assembly 22 is lifted off of the mounts 40, the latches 48 of the attachments arms 90 must be actuated to either change recline position or to remove the bouncer frame assembly 22 from the swing frame 20. For example, to remove the bouncer seat assembly 22 from the swing 1, the caregiver can actuate the latches 48 on the attachment assemblies 90, to cause the tabs to disengage from the slots of the mounts 40. With the latches 48 actuated, the caregiver then can lift the bouncer seat assembly 22 upwards to separate the mounts 40 from the respective attachment assemblies 90, and the caregiver can then place the bouncer seat assembly 22 on a support surface, such as a table or a floor.

The hanger arms 30, mounts 40, and the various attachment assembly components of the bouncer seat assembly 22 can be formed of various materials, such as metal or plastic.

When a caregiver has to leave an area nearby where a child is swinging on a swing 1, the caregiver can easily detach the bouncer seat assembly 22 from the swing 1, and carry the bouncer seat assembly 22 to any location the caregiver needs to go. Once the bouncer seat assembly 22 is detached from the swing frame 10, the bouncer frame 77 can be placed on a support surface, so that a child placed in the seat 20 can bounce up and down to entertain himself or herself. This will make it less likely that the child will be upset when removed from the swing frame 10.

FIGS. 10A-10C, 11A, 11B and 12 show the various components of the attachment assemblies 90 and the mounts 30. The attachment assembly 90 can include an outer side shell 90A and an inner side shell 90B, which are coupled together in a rigid manner (e.g., screwed together and/or glued together) to form a circular-shaped attachment assembly 90. The inner side shell 90B has as a semi-circular shape (see FIGS. 10C, 11B). The outer side shell 90A has a left side and a right side flap (see FIGS. 10A, 11B) with the channel 65 provided therebetween. The mount 40 comprises an inner side shell 40A and an outer side shell 40B, which are coupled together to form a circular-shaped mount 40. The mount 40 also includes a post receiving portion 82, as shown in FIG. 12, for receiving an end of the hanger arm 30, and by which the mount 40 is rigidly held in place on the hanger arm 30. The mount 40 can be screwed onto the hanger arm 30, as seen, for example, in FIGS. 1-3, in order to provide a very rigid coupling of these components.

FIGS. 13-16 show another example of a bouncer seat assembly 100 constructed in accordance with the teachings of the present invention. A typical bouncer seat is designed to have spaces between parts of the wire frame large enough so that a head of a child can not get pinched between parts. In practice, there is typically at least one joint or bend on each side of a conventional seat that could still permit this to happen. Additionally, the bouncer seat frames may become excessively large in trying to meet this requirement.

In order to test for this purpose, an industry standard head probe representative of a specified percentile size child within the percentile range of a given age, such as for example a 13 month old child, might be used. By way of example, the ASTM standards call out a head probe having a simple spherical shape with an 8 inch diameter. Such a head probe is said to be representative of a 95 percentile tip-of-chin to back-of-head dimension for a 13 month old child. The gaps referred to below need not be limited to this ASTM size head probe. But in one example, such a probe may be used to determine the bouncer seat structure. In this example, a wire frame structure is described that creates has at least one space between parts of the seat where a head of a child can not fit. The above probe can be used in one example to determine that size for such spaces or gaps.

Figure 13:
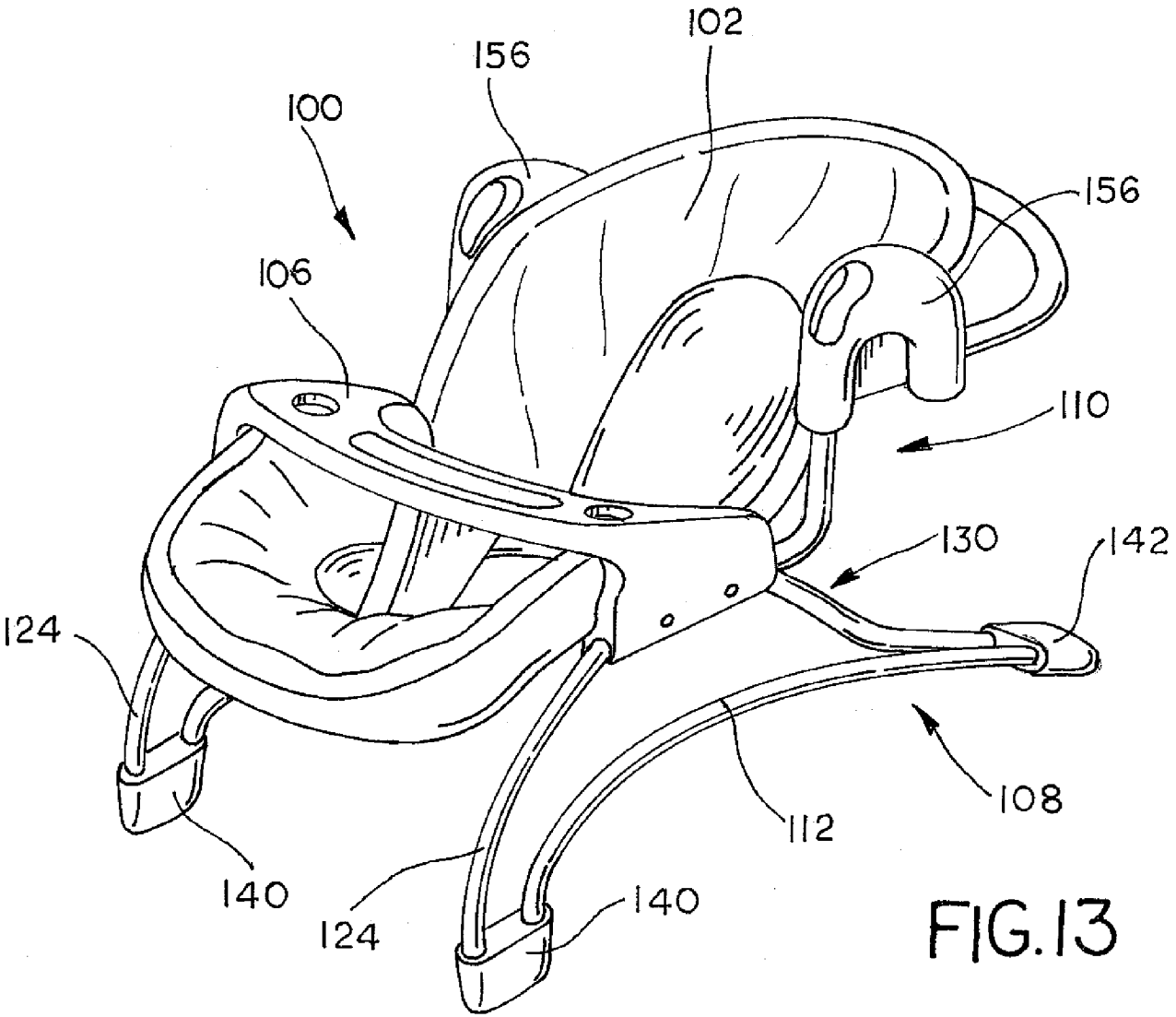
FIG. 13 is front perspective view of another example of a bouncer seat assembly according to the teachings of the invention.
Figure 14:
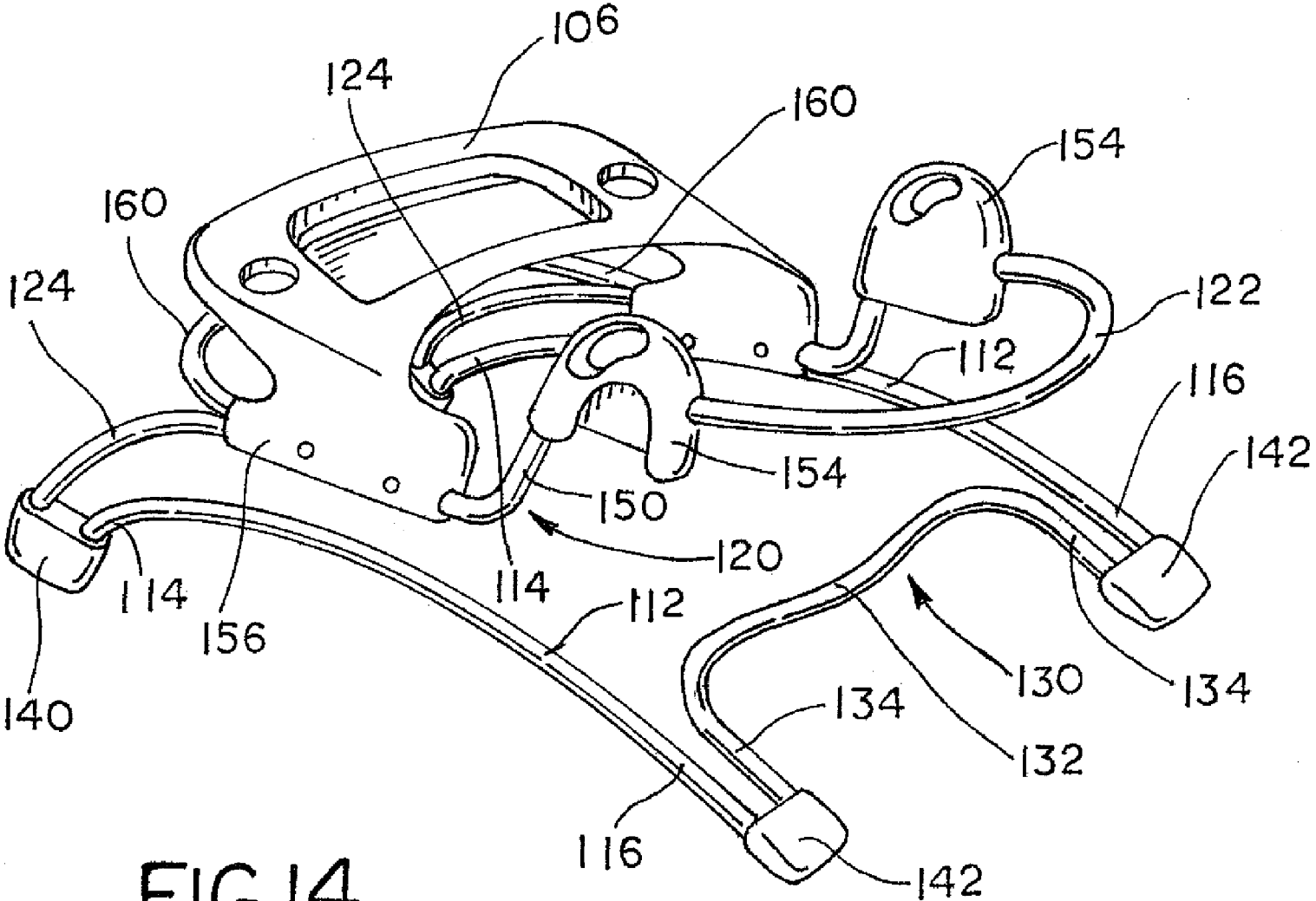
FIG. 14 is a front perspective view of a seat included on the bouncer seat frame assembly in FIG. 13.
Figure 15:
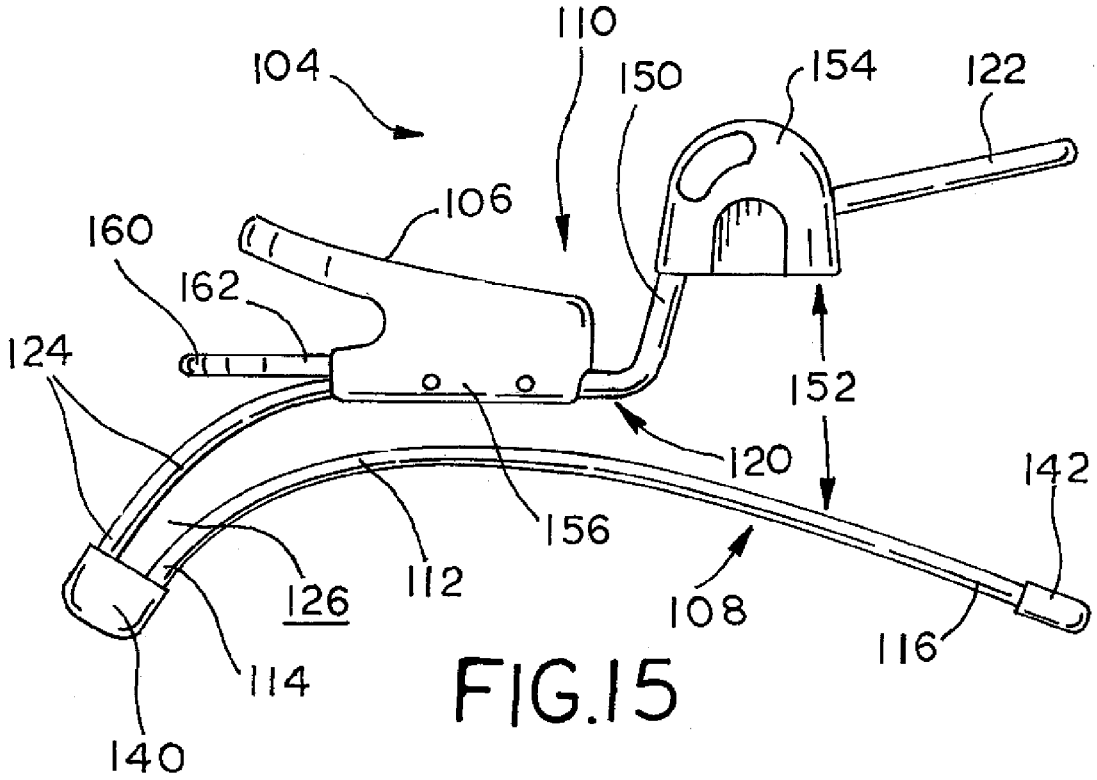
FIG. 15 is a side view of the bouncer seat in FIG. 13.
Figure 16:
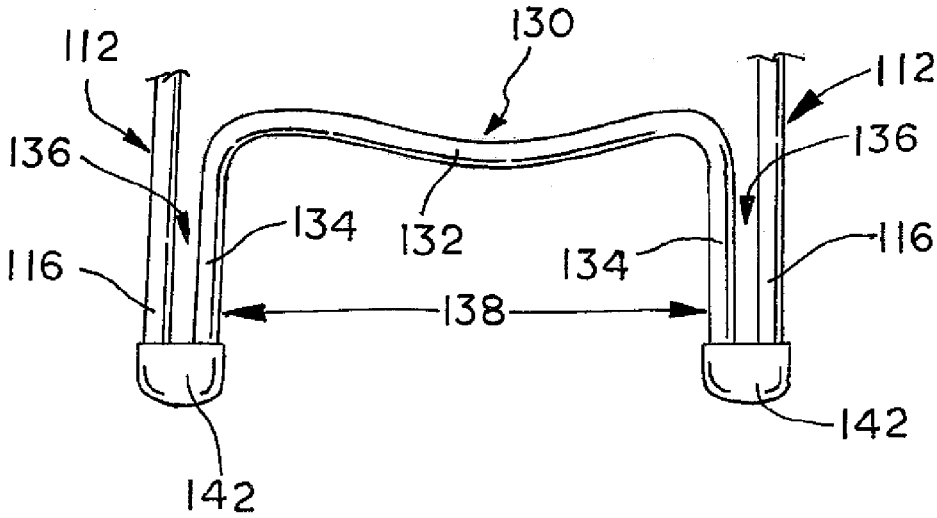
FIG. 16 is a fragmentary rear view of part of the frame of the bouncer seat in FIG. 13.

In this example, seat fabric 102 or other suitable seat material is suspended a wire frame assembly 104 of the seat assembly 100. The frame assembly minus the fabric is illustrated in FIGS. 14 and 15 and the entire seat assembly 100 is shown in FIG. 13. FIG. 15 shows the configuration of a rear part of the frame assembly 104 as described below. The seat assembly is shown in FIG. 13 as having an optional tray 106 spanning the seat between sides of the assembly.

The wire frame assembly 104 in this example has a base section 108 and a seat section 110. The base section 108 is configured to resiliently support the seat section 110 above the ground or floor so that the seat section can bounce relative to the base section. In this example, the base section 108 has a pair of laterally spaced apart bottom wires 112. These wires 112 are upwardly bent between front ends 114 and rear ends 116. The seat section 110 has a pair of laterally spaced apart side wires 120 that are interconnected at the top of the seat section by a seat back wire 122 that gradually curves upward and inward from each of the sides.

Each side wire 120 has a forward extending leg 124 that is resiliently coupled to the front end 114 of a respective one of the bottom wires 112. Each leg 124 is positioned vertically above the front end of the adjacent bottom wire 112 and follows the bottom wire contour in this example. A first vertical gap 126 is defined between the bottom wire 112 and the forward extending leg 124 of the seat section 110 on each side 120 of the seat assembly. These vertical gaps are sized to be small enough so that a head of a child can not fit between the base section and seat section wires.

A rear transverse wire section 130 is positioned laterally between the rear ends 116 of the bottom wires 112. The transverse wire section 130 has a lateral part 132 connected to and extending between a pair of rearward legs 134. The legs 134 extend in a longitudinal direction generally parallel to the bottom wires. Each rear leg 134 is resiliently coupled to the rear end 116 of one of the bottom wires 112 and is spaced inward from its respective or adjacent bottom wire. A first horizontal gap 136 is defined between each rearward leg 134 and bottom wire 112. these first horizontal gaps are each small enough so that a head of a child can not fit between the rear ends 116 of the bottom wires 112 and the rearward legs 134 of the transverse wire 130. A second horizontal gap 138 is defined between the rearward legs 134 of the transverse wire 130. This gap 138 is large enough so that a head of child, if positioned in the gap 138 can not be pinched or entrapped between the legs 134.

A plastic connector or end cap 140 is coupled to the front ends 114 of the bottom wires 112 and part of the forward extending legs 124 of seat section 108 on each side of the seat assembly 100. In one example, the parts 140 are true connectors that are attached to the exposed ends of two separate wire components and form a connection between them. In another example, the parts 140 are covers or travel limiters and attach over a continuously bent wire. In such an example, the front ends 114 of the bottom wires 112 would continue through a bend into the legs 124. In either example, some resiliency is necessary between the bottom wires 112 and the legs 124 for the bouncer seat assembly 100 to function as a bouncer. In this example, the parts 140 are vertically oriented because the bottom wires 112 and the legs 124 are vertically aligned.

Similarly, a part 142 is coupled to the rear ends 116 of the bottom wires 112 and part of the rearward legs 134 of the transverse wire 130 on each side of the seat assembly 100. Again, the wires can be a continuous bent wire covered by the parts 142, or can be separate wires connected by the parts. However, in this example the parts 142 are oriented horizontally because the wires are laterally aligned. The parts 140 and 142 in either example can also act as spacers to set the desired distance for the gaps 126 and 136.

Each side 120 of the seat section 110 has an intermediate wire region 150. The regions 150 are positioned on each side of the seat section between the respective forward leg 124 and the transverse seat back wire 122. The intermediate wire regions 150 each abruptly bend upward away from the adjacent bottom wire 112. This creates a second vertical gap 152 between the bottom wires 112 and the intermediate regions 150 on each side 120 of the seat assembly 100. The second gaps 152 are large enough so that a head of child, if positioned in these gaps, can not be pinched or entrapped between the seat section 110 and the bottom wires 112.

As shown in FIGS. 13-16, the bouncer seat assembly 100 can also be provided with swing couplers or connectors 154 attached to sides of the seat. The intermediate wire regions 150 can be configures to attach to the swing couplers 154 and positioned to removably couple the seat assembly to the swing arms of a swing frame as previously described herein. However, the frame assembly 104 in this example can certainly be used as a stand alone bouncer seat with no swing attachment capability. The safety of the seat frame assembly 104 is suited for either application. However, the frame assembly 104 described herein enhances the safety of a bouncer/swing seat as previously described because the frame is elevated above the floor when mounted in a swing. A child can very easily walk or crawl under the seat assembly when suspended in a swing frame.

The frame assembly 104 in this example also has a pair of side connectors 156 attached to the sides 120 of the seat section 110. The tray 106 is coupled to these side connectors in this example. The tray need not be present, if desired. The tray alternatively can be integrally formed as part of the connectors or can be designed as removable from the connectors. In this example, a seat bottom wire 160 curves gradually forward and between the sides of the seat section. The ends 162 of the seat bottom wire 160 are connected to the side connectors 156 in this example. As shown in FIG. 13, the seat material 102 is suspended partly from the seat bottom wire 160, partly from the seat back wire 122, and parts of the side wires 120, as needed.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. For example, for swings that have one hanger arm that extends downward from a central portion of a closed top swing, the attachment assemblies 90 of the bouncer seat assembly may be rigidly connected to a rear exterior shell of the child seat 20, in order to thereby be coupled to a mount of the centrally-positioned hanger arm. Furthermore, other locations for the attachment assemblies 90 besides what is shown and described herein may be contemplated (e.g., coupled to the base frame 79 of the bouncer frame 77). Also, other types of seats besides bouncer seats may be coupled to a swing frame using the attachment assemblies described hereinabove. For example, a jumper seat, a bassinet/sleeper seat, a changing table, or a purely stationary seat can be adapted to include attachment assemblies, so as to be attachable to a swing in accordance with at least one embodiment of the invention. Also, in an alternative construction, the attachment assembly for the seat (that attaches to the mounts of the swing) can be provided as part of the same mold that forms the child seat, thereby forming an integral child seat. Furthermore, in another configuration, the seat can be designed to detach freely from the swing frame at any recline position, in which case a latch is not needed in the attachment assembly. The spirit and scope of the invention are indicated by the following claims.

What is claimed is:

1. A bouncer seat assembly comprising:

a wire frame;

a seat suspended from portions of the wire frame, the wire frame including a base section with a pair of laterally spaced apart bottom wires each upwardly curved between respective front and rear ends, and a seat section having a pair of laterally spaced apart side wires interconnected by a transverse seat back wire, each side wire having a forward leg resiliently coupled to the front end of one of the bottom wires and each forward leg being spaced from the respective bottom wire by a first gap sized small enough to prohibit a head or neck of a child from fitting between the bottom wires and the adjacent forward legs;

a swing frame having a support structure and a pair of swing arms pivotally suspended from the support structure; and a swing connector carried on each side of the wire frame and configured to removably connect to a respective one of the swing arms.

2. A bouncer seat assembly according to claim 1, wherein each forward leg of the seat section is positioned vertically above the respective bottom wire.

3. A bouncer seat assembly according to claim 1, further comprising:

a plastic end cap connected to the front end of each bottom wire and to the respective forward leg.

4. A bouncer seat assembly according to claim 1, wherein each bottom wire is integrally formed with and connected to the respective forward leg by a front bend.

5. A bouncer seat assembly according to claim 4, further comprising a plastic end cap connected to and covering each front bend, the front end of each bottom wire, and part of each of the forward legs.

6. A bouncer seat assembly comprising:

a wire frame; and a seat connected to portions of the wire frame, the wire frame including a base section with a pair of laterally spaced apart bottom wires each upwardly curved between respective front and rear ends, a seat section having a pair of laterally spaced apart side wires interconnected to the seat, each side wire having a forward leg resiliently coupled to the front end of one of the bottom wires and each forward leg being spaced from the respective bottom wire by a first gap sized small enough to prohibit a head or neck of a child from fitting between the bottom wires and the adjacent forward legs, and a rear transverse section positioned laterally between the bottom wires and having a lateral part connected to and extending between a pair of rearward legs, each rearward leg being resiliently coupled to the rear end of one of the bottom wires and each being spaced inward from the respective bottom wire by a second gap sized small enough to prohibit a head of a child from fitting between the bottom wires and the respective rearward legs.

7. A bouncer seat assembly according to claim 6, wherein each forward leg of the seat section is positioned vertically above the respective bottom wire.

8. A bouncer seat assembly according to claim 6, a plastic end cap connected to the rear end of each bottom wire and to the respective rearward leg of the transverse section.

9. A bouncer seat assembly according to claim 6, wherein each bottom wire is integrally formed with and connected to the respective rearward leg of the transverse section by a rear bend.

10. A bouncer seat assembly according to claim 9, further comprising a plastic end cap connected to and covering each rear bend, the rear end of each bottom wire, and part of each of the rearward legs of the transverse section.

11. A bouncer seat assembly according to claim 6, wherein the entire transverse section is laterally aligned with and follows the same contour as the bottoms wires in a longitudinal direction of the bouncer seat assembly.

12. A bouncer seat assembly comprising:

a wire frame; and a seat suspended from portions of the wire frame, the wire frame including a base section with a pair of laterally spaced apart bottom wires each upwardly curved between respective front and rear ends, a seat section having a pair of laterally spaced apart side wires interconnected by a transverse seat back wire, each side wire having a forward leg resiliently coupled to the front end of one of the bottom wires and each forward leg being spaced from the respective bottom wire by a first gap sized small enough to prohibit a head or neck of a child from fitting between the bottom wires and the adjacent forward legs, and an intermediate region positioned on each side of the seat section between the respective forward leg and transverse seat back wire, the intermediate region abruptly bending upward away from the adjacent bottom wire creating a third gap sized to prevent a head of a child from being entrapped or pinched between the bottom wires and any part of the seat section rearward of the forward legs.

13. A bouncer seat assembly according to claim 12, further comprising:

a swing frame having a support structure and a pair of swing arms pivotally suspended from the support structure; and a swing connector carried on each of the intermediate wire regions of the seat support section and configured to removably connect to a respective one of the swing arms.

14. A bouncer seat assembly comprising:

a wire frame;

a seat coupled to the wire frame, the wire frame including a base section with a pair of laterally spaced apart bottom wires each upwardly curved between respective front and rear ends, and a seat section with a pair of laterally spaced apart side wires each having a forward leg resiliently coupled to the front end of one of the bottom wires and each forward leg being spaced from the respective bottom wire by a first gap sized small enough to prohibit a head or neck of a child from fitting between the bottom wires and the adjacent forward legs;

a swing frame having a support structure and a pair of swing arms pivotally suspended from the support structure; and a swing connector carried on each side of the wire frame and configured to removably connect to a respective one of the swing arms.

15. A bouncer seat assembly comprising:

a wire frame;

a seat suspended from portions of the wire frame, the wire frame including a base section with a pair of laterally spaced apart bottom wires each upwardly curved between respective front and rear ends, and a seat section having a pair of laterally spaced apart side wires interconnected by a transverse seat back frame part, each side wire having a forward leg resiliently coupled to the front end of one of the bottom wires and each forward leg being spaced from the respective bottom wire by a first gap sized small enough to prohibit a head or neck of a child from fitting between the bottom wires and the adjacent forward legs;

a connector attached to each side of the seat section rearward of the forward legs; and a transverse front seat support extending across the bouncer seat assembly and coupled to each of the connectors, a seat bottom part of the seat material suspended from the front seat support, and a seat back part of the seat material suspended by the transverse seat back frame part.

16. A bouncer seat assembly comprising:

a wire frame; and a seat suspended from the wire frame, the wire frame including a seat section, and a base section resiliently and flexibly coupled to and supporting the seat section above the base section, wherein the wire frame is configured to create gaps between parts of the bouncer seat assembly that include at least one gap sized small enough to prohibit a head of a child from fitting between any adjacent parts, wherein the base section has a pair of laterally spaced apart bottom wires with rear ends, and wherein a transverse bent frame part is positioned between and interconnects the rear ends of the bottom wires, the transverse bent frame part having a pair of spaced apart rearward extending legs interconnected by a lateral part, each leg spaced laterally inward from one of the rear ends of the bottom wires and following a contour of the bottom wires such that a head of a child can not fit within first horizontal gaps the rear ends of the bottom wires and the adjacent legs.

17. A bouncer seat assembly according to claim 16, wherein the seat section has a pair of laterally spaced apart bent seat wires, and wherein the base section has a pair of laterally spaced apart and upwardly curved bottom wires, and wherein front parts of the seat wires extend above and follow the contour of front ends of the bottom wires such that a head of a child can not fit within a vertical gap between the front ends of the bottom wires and the front parts of the seat wires.

18. A bouncer seat assembly according to claim 16, wherein a head of a child can not be entrapped or pinched within a second horizontal gap between the legs of the transverse bent wire.

* * * * *